US007721631B2

(12) United States Patent
Berg et al.

(10) Patent No.: US 7,721,631 B2
(45) Date of Patent: May 25, 2010

(54) COMBINED WRENCH AND MARKING SYSTEM

(75) Inventors: Frederic P. Berg, Seattle, WA (US); Mark E. Hulscher, Seattle, WA (US)

(73) Assignee: The Boeing Company, Chicago, IL (US)

( * ) Notice: Subject to any disclaimer, the term of this patent is extended or adjusted under 35 U.S.C. 154(b) by 137 days.

(21) Appl. No.: 11/935,263

(22) Filed: Nov. 5, 2007

(65) Prior Publication Data

US 2009/0114067 A1 May 7, 2009

(51) Int. Cl.
*B25B 23/14* (2006.01)

(52) U.S. Cl. ..... 81/468; 73/862.21

(58) Field of Classification Search ..... 81/468, 81/60; 73/862.21–862.23, 862.26, 862.321, 73/862.338

See application file for complete search history.

(56) References Cited

U.S. PATENT DOCUMENTS

| | | | | |
|---|---|---|---|---|
| 3,523,471 | A | 8/1970 | Lance | |
| 3,667,327 | A | 6/1972 | Lance | |
| 3,693,483 | A | 9/1972 | Palmer et al. | |
| 3,774,479 | A * | 11/1973 | Lesner | 81/468 |
| 3,802,301 | A | 4/1974 | Peterson | |
| 3,918,609 | A | 11/1975 | Peterson | |
| 4,211,120 | A | 7/1980 | Tambini | |
| 4,393,734 | A | 7/1983 | Thorn et al. | |
| 4,768,407 | A | 9/1988 | Bratt et al. | |
| 4,925,061 | A | 5/1990 | Jeromson, Jr. et al. | |
| 4,999,645 | A | 3/1991 | Grattan et al. | |
| 5,533,409 | A | 7/1996 | Crane et al. | |
| 5,581,042 | A | 12/1996 | Tambini | |
| 5,589,644 | A | 12/1996 | Becker et al. | |
| 5,890,406 | A | 4/1999 | Thorn | |
| 6,167,788 | B1 | 1/2001 | Schonberger et al. | |
| 7,565,844 | B2 * | 7/2009 | Crass et al. | 73/862.21 |

(Continued)

FOREIGN PATENT DOCUMENTS

| | | | |
|---|---|---|---|
| DE | 2612677 | A1 | 7/1977 |
| GB | 2100171 | A | 12/1982 |

OTHER PUBLICATIONS

"Low-Pressure Spray Marking Systems", Dell Marking Systems, Ferndale, Michigan, pp. 1-2.retrieved Sep. 5, 2007. www.dellid.com.

(Continued)

*Primary Examiner*—D. S Meislin
(74) *Attorney, Agent, or Firm*—Yee & Associates, P.C.; Dennis R. Plank

(57) ABSTRACT

Self-contained, combined wrench and marking system, and method for installing a fitting and for automatically marking an installed fitting. The self-contained combined wrench and marking system has a wrench that may include a wrench head for rotating a fastener during a fastener tightening operation, a torque measuring mechanism for measuring a torque applied to the fastener during the fastener tightening operation, and an angle measuring mechanism for rotating the fastener to a preset angle during the fastener tightening operation. The self-contained combined wrench and marking system also has a marking system for automatically marking the fastener after the torque is applied to the fastener and after rotating the fastener to the preset angle.

16 Claims, 10 Drawing Sheets

U.S. PATENT DOCUMENTS

2005/0061119 A1 3/2005 Becker
2005/0092143 A1 5/2005 Lehnert et al.
2005/0111995 A1 5/2005 Everson
2005/0223856 A1 10/2005 Reynertson et al.
2006/0009924 A1* 1/2006 McGee et al. ..... 702/41
2008/0061081 A1* 3/2008 Guerrero et al. ..... 222/148
2008/0196558 A1* 8/2008 Picone ..... 81/171
2009/0250233 A1* 10/2009 Wallace ..... 173/1

OTHER PUBLICATIONS

"Introducing the Next Generation of Torque Verification", Belknap Company Inc., Wixom, Michigan, 1 page www.belknaptools.com.
"Carco 'Jet Shot' Systems", Carco Inc., pp. 1-3, retrieved Sep. 5, 2007 http://www.carcousa.com/non-contact-marking.html.
"10-Bit Programmable Magnetic Rotary Encoder", austriamicrosystems, revision 1.3, Oct. 25, 2005, p. 1.

* cited by examiner

| | 1202 | 1204 | 1206 | 1208 | | 1210 | 1212 |
|---|---|---|---|---|---|---|---|
| FUNCTION | INK SPRAY | $CO_2$ SPRAY | INK AMOUNT | CHANGE OR CLEAR INK | | MEASURE ANGLE | CALIBRATE |
| DISPLAYED | ISP | CSP | IA- | CII | | A- | CAL |
| ACTION REQUIRED | PRESS MODE TO EXECUTE | PRESS MODE TO EXECUTE | PRESS MODE TO EXECUTE | PRESS MODE TO EXECUTE | | PRESS MODE TO EXECUTE | PRESS MODE TO EXECUTE |
| DISPLAY | NONE | NONE | CURRENT INK AMOUNT DISPLAYED | SEQUENTIALLY 1,2,3,...9 | | NONE | FIRST: 1,2,3,...9 SECOND: 1,2,3,...9 |
| ACTION REQUIRED | NONE | NONE | AT DESIRED NUMBER (8-20) PRESS ON/SET | AT NUMBER 3 PRESS ON/SET | | NONE | ENTER TWO DIGIT CODE |
| DISPLAY | | | | CHI (CHANGE INK) | CLI (CLEAR INK) | | |
| ACTION REQUIRED | | | | PRESS MODE TO EXECUTE | PRESS MODE TO EXECUTE | | |

*FIG. 12*

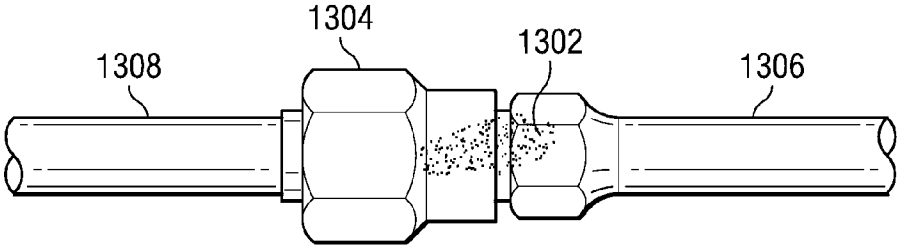

*FIG. 13*

COMBINED WRENCH AND MARKING SYSTEM

BACKGROUND INFORMATION

1. Field

The disclosure relates generally to a method and apparatus for installing fluid fittings and fasteners. More particularly, the present disclosure relates to a self-contained, combined wrench and marking system for installing and marking fluid fittings and fasteners, and to a method for installing and marking fluid fittings and fasteners.

2. Background

An aircraft includes many movable structures, for example and without limitation, wing flaps, vertical fins and ailerons, that are operated hydraulically. Accordingly, a typical aircraft may include many hydraulic lines that extend throughout the aircraft and that are comprised of numerous line sections joined together by fluid fittings.

The fittings are assembled to the line sections using nuts, and it is important that the assembled structures be fluid-tight. In a typical procedure for installing a hydraulic line in an aircraft, a mechanic first loosely attaches one end of a fitting to a line section by hand-tightening the nut at the one end of the fitting, then stretches or compresses the line section so that the opposite end of the fitting can be attached to another line section, again by hand-tightening the nut at the opposite end of the fitting. The mechanic then further tightens the nuts, first at one end and then at the opposite end of the fitting. This process of alternately tightening the nuts at the ends of the fitting may be repeated two or three times until the nuts at both ends of the fitting are fully tightened.

A mechanic may install several hundred hydraulic fittings in a day, and to help ensure that all nuts and fittings have been properly tightened, it is often the practice to mark a nut and/or fitting after it has been fully tightened.

As a result of the process of alternately and repeatedly tightening the nuts at the opposite ends of a fitting, however, it is not uncommon that the mechanic might inadvertently fail to fully tighten the nut at one or both ends of a fitting, yet still mark the nuts as being fully tightened.

All fittings in a hydraulic line of an aircraft are subjected to leak-testing such that any nuts that may have been only hand-tightened or that were otherwise improperly installed will be identified and properly fastened. When a fitting fails leak-testing, however, it is necessary to clean the leaked aviation hydraulic fluid (e.g., Skydrol) from surrounding surfaces, and to then fully tighten any loose nuts prior to retesting of the fitting. In addition to being time consuming, the preferred cleaning agent used to clean the leaked aviation hydraulic fluid is Freon which is a hazardous material and may also cause damage to the surrounding surfaces that requires repair.

Thus, it would be desirable to minimize the number of fittings that fail during leak-testing.

The typical procedure for marking an assembled hydraulic joint requires the mechanic to apply a colored compound, (e.g., Inspection seal lacquer F925) by squeezing a small tube so that a stripe of the compound, sometimes referred to as a "torque stripe", covers both the fitting and the nut. This procedure for marking an installed hydraulic joint may be unsatisfactory.

One problem, as indicated above, is that the mechanic may inadvertently mark a fitting that has not been fully tightened. Also, these manual marking procedures are time consuming and reduce productivity. Recognizing the inadequacies of manual marking procedures, a marking wrench was developed. The prior art marking wrench both tightens a fastener and then marks the tightened nut with ink to indicate that the nut has been tightened.

The prior art marking wrench, however, is still not fully satisfactory. For one thing, the marking wrench only marks the nut and not its mating fitting. It is desirable to have the mark cover both nut and fitting so that it would be known if someone loosened, or tampered with the nut. A misaligned mark on the nut and fitting surfaces flags this condition. The prior art marking wrench is also non-ratcheting which makes operation of the wrench rather slow. Furthermore, the prior art marking wrench contacts the nut with ink impregnated felt, but trials of this wrench found that the felt dried up, rendering its marking capability useless.

There is, accordingly, a need for a mechanism for installing fittings and fasteners in hydraulic lines in an aircraft and in other applications that will minimize fluid leaks during leak-testing, and that will also automatically mark installed fittings and fasteners after they have been properly installed.

SUMMARY

An embodiment of the disclosure provides a self-contained combined wrench and marking system. The self-contained combined wrench and marking system has a wrench that may include a wrench head for rotating a fastener during a fastener tightening operation, a torque measuring mechanism for measuring a torque applied to the fastener during the fastener tightening operation, and an angle measuring mechanism for rotating the fastener to a preset angle during the fastener tightening operation. The self-contained combined wrench and marking system also has a marking system for automatically marking the fastener after the torque is applied to the fastener and after rotating the fastener to the preset angle.

A further embodiment of the disclosure provides a self-contained combined wrench and marking system. The self-contained combined wrench and marking system has a wrench that may include a wrench head for tightening a fastener during a fastener tightening operation. The self-contained combined wrench and marking system also has a marking system for automatically marking the fastener after tightening the fastener. The marking system may include a marking fluid reservoir containing a marking fluid, a spray nozzle line connected to the marking fluid reservoir for receiving the marking fluid from the marking fluid reservoir, a replaceable gas cartridge containing a gas propellant, and a control valve for delivering the gas propellant from the replaceable gas cartridge to the spray nozzle line for spraying the marking fluid for marking the fastener.

A further embodiment of the disclosure provides a method for installing a fitting and for marking automatically an installed fitting. The method may include rotating a fastener to attach the fitting during a fastener tightening operation, measuring a torque applied to the fastener during the fastener tightening operation, and rotating the fastener to a preset angle during the fastener tightening operation. The method may also include marking automatically the installed fitting and the fastener after applying the torque to the fastener and after rotating the fastener to the preset angle.

A further embodiment of the disclosure provides a A self-contained combined wrench and marking system. The self-contained combined wrench and marking system has a wrench. The wrench may include a ratcheting wrench head for rotating a fastener during a fastener tightening operation, and a torque measuring mechanism for measuring a torque applied to the fastener during the fastener tightening operation. The torque measuring mechanism may include a strain-beam that is stressed during the fastener tightening operation, and a stress measuring mechanism for measuring an amount of stress on the strain-beam, wherein the amount of stress is related to torque. The wrench may also include an angle measuring mechanism for rotating the fastener to a preset angle during the fastener tightening operation, and the angle measuring mechanism may include a gyroscope. The self-contained combined wrench and marking system also has a marking system for automatically marking the fastener after the torque measuring mechanism determines that the torque applied to the fastener is equal to a preset torque value and after the angle measuring mechanism determines that the fastener is rotated to the preset angle. The marking system may include a marking fluid reservoir containing a marking fluid, a spray nozzle line connected to the marking fluid reservoir for receiving the marking fluid from the marking fluid reservoir, and a replaceable gas cartridge containing a gas propellant. A first control valve may deliver the gas propellant from the replaceable gas cartridge to the marking fluid reservoir for delivering the marking fluid from the marking fluid reservoir to the spray nozzle line, and a second control valve may deliver the gas propellant from the replaceable gas cartridge to the spray nozzle line for spraying the marking fluid for marking the fastener.

A further embodiment of the disclosure provides a method for installing a fitting and for marking automatically an installed fitting. The method includes a fastener tightening operation. The fastener tightening operation may include rotating a fastener to attach the fitting, measuring a torque applied to the fastener while rotating the fastener to apply a preset torque to the fastener, and measuring a rotation angle of the fastener while rotating the fastener for rotating the fastener to a preset angle to install the fitting. The method also includes a marking operation for marking automatically the installed fitting and the fastener. The marking operation may include delivering a gas propellant from a replaceable gas cartridge to a marking fluid reservoir for delivering a marking fluid from the marking fluid reservoir to a spray nozzle line, and delivering the gas propellant from the replaceable gas cartridge to the spray nozzle line for spraying the marking fluid from the spray nozzle line.

The features, functions, and advantages can be achieved independently in various embodiments or may be combined in yet other embodiments.

BRIEF DESCRIPTION OF THE DRAWINGS

The novel features believed characteristic of the embodiments are set forth in the appended claims. The embodiments themselves, however, as well as a preferred mode of use, further objectives and advantages thereof, will best be understood by reference to the following detailed description of advantageous embodiments when read in conjunction with the accompanying drawings.

FIG. 12 is an illustration of a Table that describes options that may be selected during the options mode in the flowchart of FIGS. 11A and 11B according to an advantageous embodiment of the disclosure;

FIG. 13 is an illustration that shows an ink mark sprayed on both a nut and a fitting that has been assembled to a hydraulic line section according to an advantageous embodiment of the disclosure;

DETAILED DESCRIPTION

Figure 1:
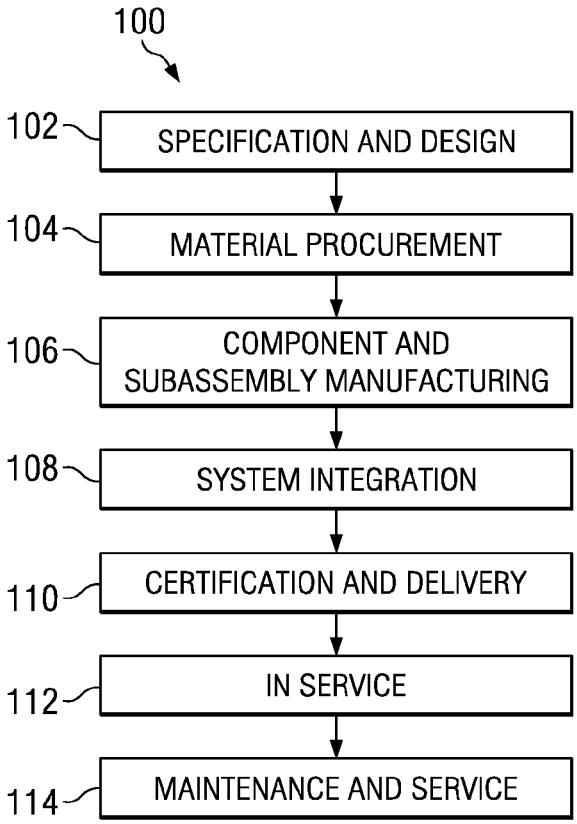
FIG. 1 is a flow diagram of aircraft production and service methodology.
Figure 2:
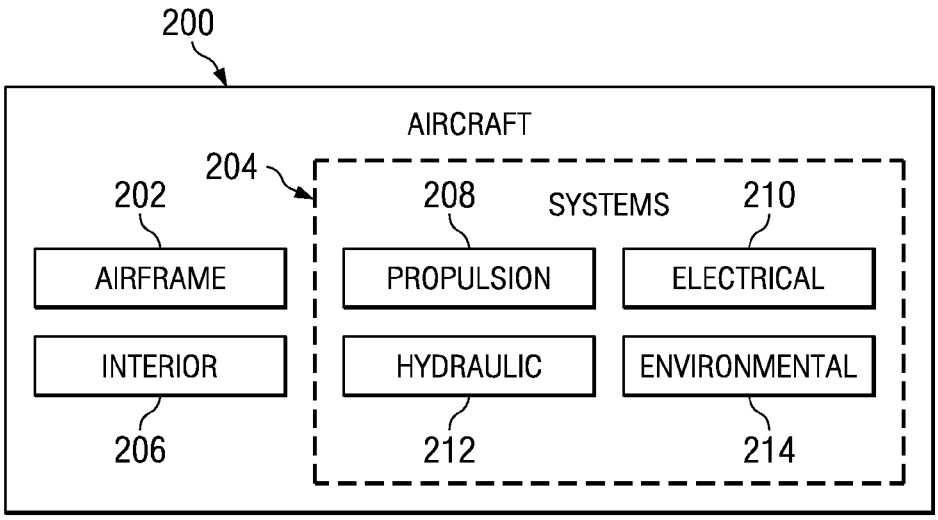
FIG. 2 is a block diagram of an aircraft.

Referring more particularly to the drawings, embodiments of the disclosure may be described in the context of an aircraft manufacturing and service method 100 as shown in FIG. 1 and an aircraft 200 as shown in FIG. 2. During pre-production, exemplary method 100 may include specification and design 102 of the aircraft 200 and material procurement 104. During production, component and subassembly manufacturing 106 and system integration 108 of the aircraft 200 takes place. Thereafter, the aircraft 200 may go through certification and delivery 110 in order to be placed in service 112. While in service by a customer, the aircraft 200 is scheduled for routine maintenance and service 114 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 2, the aircraft 200 produced by exemplary method 100 in FIG. 1 may include an airframe 202 with a plurality of systems 204 and an interior 206. Examples of high-level systems 204 include one or more of a propulsion system 208, an electrical system 210, a hydraulic system 212, and an environmental system 214. Any number of other systems may be included. Although an aerospace example is shown, the principles of the invention may be applied to other industries, such as the automotive industry.

Apparatus and methods embodied herein may be employed during any one or more of the stages of the production and service method 100. For example, components or subassemblies corresponding to production process 106 may be fabricated or manufactured in a manner similar to components or subassemblies produced while the aircraft 200 is in service. Also, one or more apparatus embodiments, method embodiments, or a combination thereof may be utilized during the production stages 106 and 108, for example, by substantially expediting assembly of or reducing the cost of an aircraft 200. Similarly, one or more of apparatus embodiments, method embodiments, or a combination thereof may be utilized while the aircraft 200 is in service, for example and without limitation, to maintenance and service 114.

Figure 3:
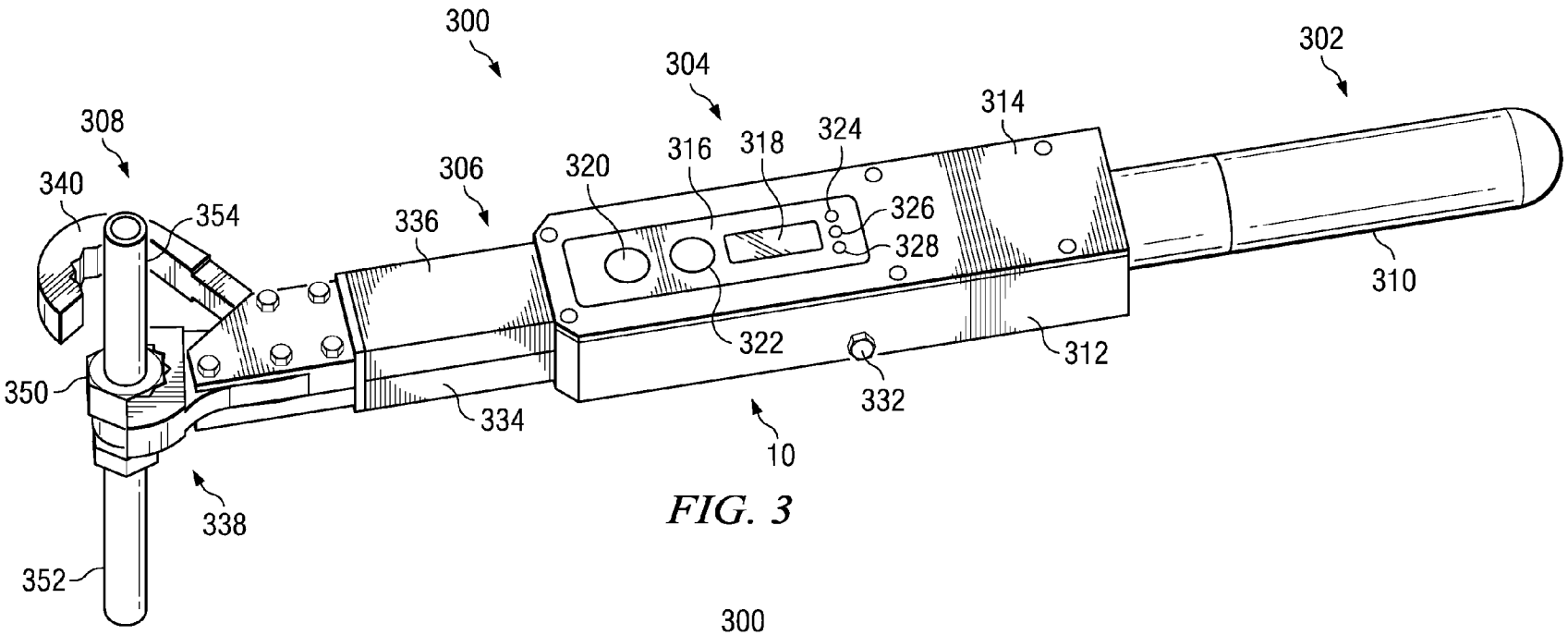
FIG. 3 is an illustration of a perspective plan view of a combined wrench and marking system according to an advantageous embodiment of the disclosure.

With reference now to FIG. 3, an illustration of a perspective plan view of a combined wrench and marking system according to an advantageous embodiment of the disclosure is depicted. The combined wrench and marking system, often referred to herein as a marking wrench, is designated by reference number 300, and generally includes handle portion 302, housing portion 304, nosepiece portion 306 and head portion 308.

Figure 4:
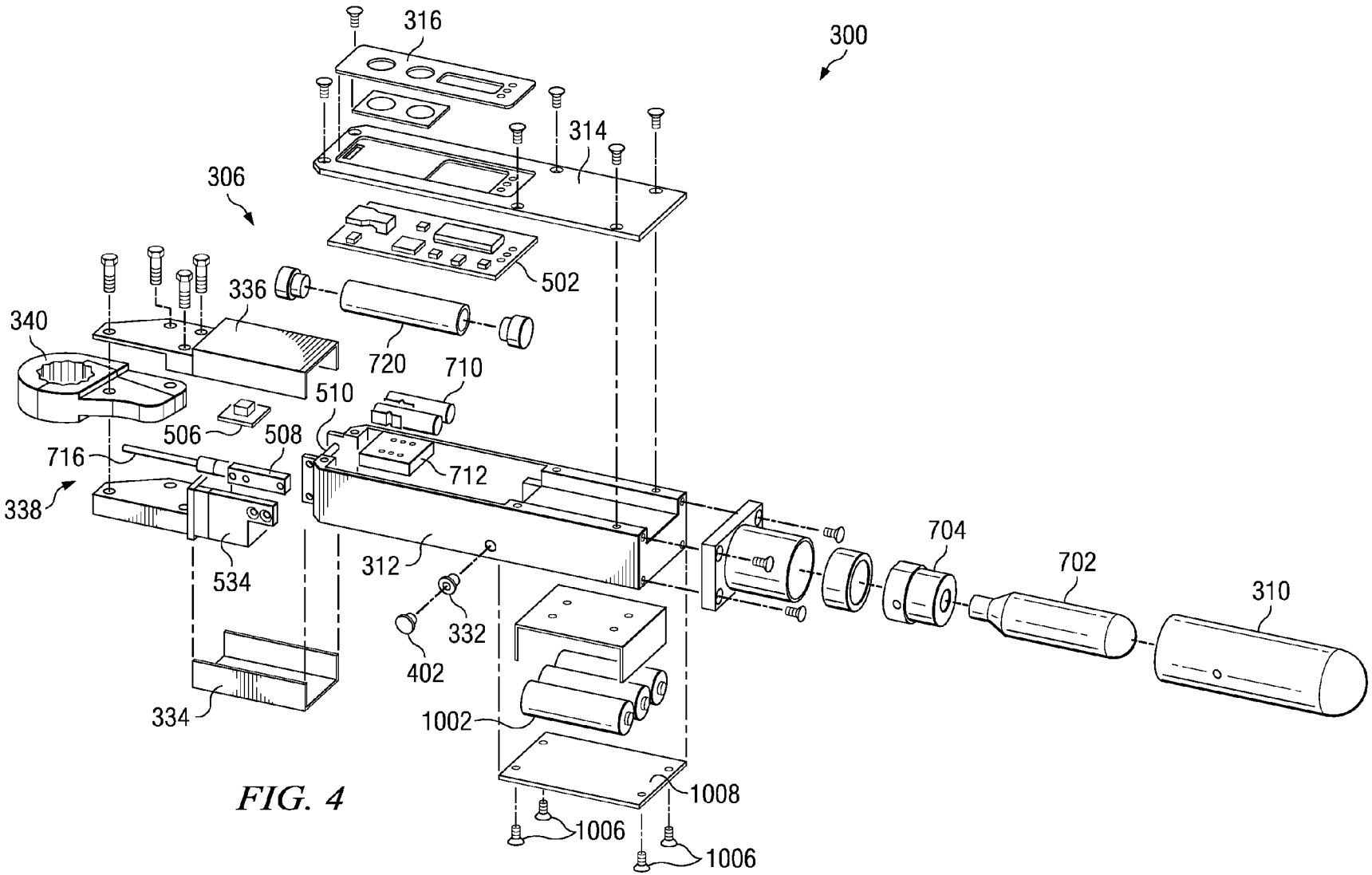
FIG. 4 is an illustration of an exploded perspective plan view of the combined wrench and marking system of FIG. 3.

FIG. 4 is an illustration of an exploded perspective plan view of the combined wrench and marking system of FIG. 3. FIG. 4 illustrates various components of marking wrench 300, and may be referred to during the following detailed description to facilitate a clear understanding of the marking wrench and its operation.

Returning to FIG. 3, handle portion 302 includes handle cap 310 for a user to hold marking wrench 300. As will be described hereinafter, handle cap 310 may be hollow to define a compartment that contains a $CO_2$ cylinder to provide pressurized gas for the marking system of the marking wrench.

Figure 9:
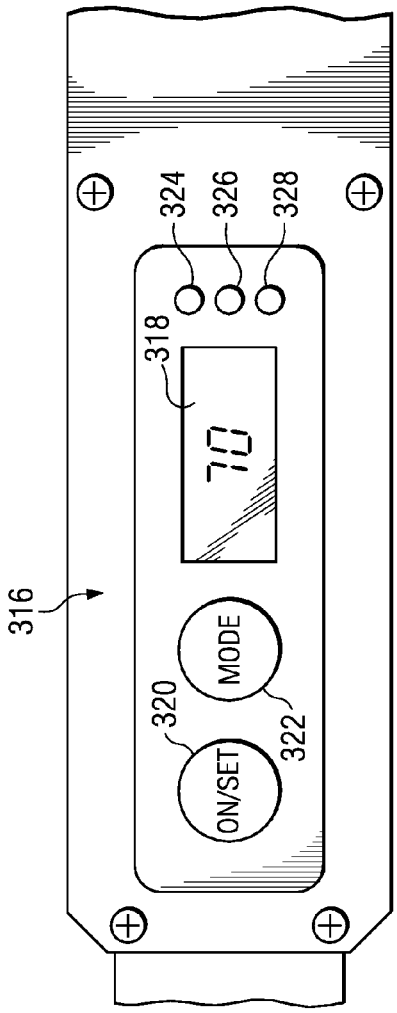
FIG. 9 is an illustration showing an enlarged view of the display and control panel of the combined wrench and marking system of FIGS. 3-5.

Housing portion 304 may include housing body 312 covered by housing body cover 314. A display and control panel 316 may be mounted on housing body cover 314. Display and control panel 316, which is also illustrated in FIG. 9 and will be described more fully hereinafter, may include display 318, On/Set button 320, mode button 322, and status lights 324, 326 and 328.

Housing body 312 may also include ink refill port 332 for refilling an ink reservoir included in the marking system of marking wrench 300.

Figure 5:
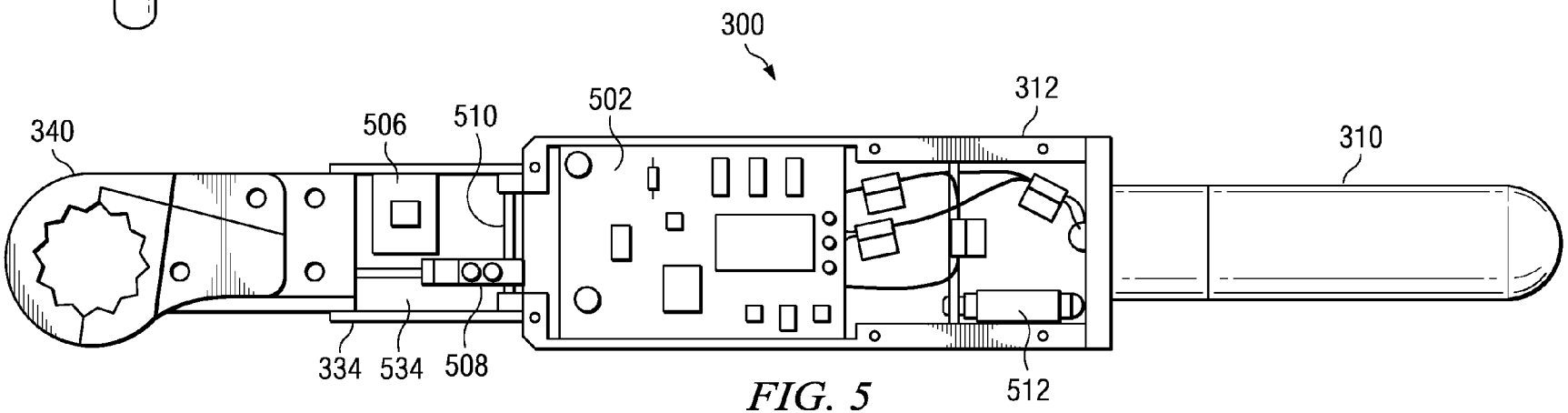
FIG. 5 is an illustration of the combined wrench and marking system of FIGS. 3 and 4 with portions removed to show internal features of the combined wrench and marking system according to an advantageous embodiment of the disclosure.

Nosepiece portion 306 includes a nosepiece body 534, which is illustrated in FIGS. 4 and 5 and will be described more fully hereinafter, that is enclosed in lower and upper nosepiece covers 334 and 336. A spray nozzle 338 of the marking system may be in the nosepiece body as illustrated in FIG. 3.

Head portion 308 includes ratcheting head 340 of the marking wrench. Ratcheting head 340 is adapted to grip and rotate a nut, such as hydraulic nut 350 in FIG. 3, in order to fasten hydraulic fitting 352 to a section 354 of a hydraulic line. More particularly, marking wrench 300 may be used to tighten hydraulic nut 350 to a preset torque value and to then rotate the nut to a preset angle in order to fully tighten the hydraulic fitting 352 to line section 354; and to then mark both the nut and the fitting with ink using the marking system of the marking wrench to indicate that nut 350 has been fully tightened and that hydraulic fitting 352 has been attached to line section 354 in a secure, leak-free manner.

In an advantageous embodiment of the disclosure, marking wrench 300 may be used to install and mark hydraulic nuts and fittings to assemble hydraulic lines of an aircraft. It should be understood, however, that the marking wrench may also be used in other fastening applications and it is not intended to limit advantageous embodiments to any particular application.

According to an advantageous embodiment, marking wrench 300 may be about 17 inches long and weigh about two pounds. Marking wrench 300 may also be less than one inch thick, and thus provides a narrow profile in the plane of rotation of the marking wrench such that the marking wrench may be used in confined areas.

FIG. 5 is an illustration of the combined wrench and marking system of FIGS. 3 and 4 with portions removed to show internal features of the combined wrench and marking system according to an advantageous embodiment of the disclosure. More particularly, FIG. 5 illustrates marking wrench 300 with housing body cover 314 and upper nosepiece body cover 336 removed. As shown in FIG. 5, marking wrench 300 may include two circuit boards, main circuit board 502 in housing body 312, and gyroscope circuit board 506, also referred to as gyroscope 506, in nosepiece body 534. By providing a separate gyroscope circuit board, if the gyroscope circuit board 506 goes bad, it may be replaced independently of main circuit board 502. Main circuit board 502 will be described more fully hereinafter in conjunction with FIG. 6.

Gyroscope 506 may be used to measure the angle of rotation of a nut being rotated (displaced angle) by marking wrench 300, for example, hydraulic nut 350 in FIG. 3. Gyroscope 506 actually measures the rate of rotation of the nut, however, this measurement is then integrated using a suitable integration numerical method algorithm, such as Simpson's rule or the trapezoidal rule, in order to determine the angle of rotation of the nut.

Also illustrated in FIG. 5 is strain-beam 508 in nosepiece body 534. Strain-beam 508 may be used to measure torque. In particular, one end of strain-beam 508 is rigidly attached to nosepiece body 534 and the other end is free, i.e., the strain-beam is in a cantilever configuration. Strain-pin 510 is screwed into the free end of strain-beam 508 and just contacts an inner wall of nosepiece body 534. This contact may be adjusted by screwing strain-pin 510 further into or further out of strain-beam 508.

Strain-beam 508 senses an amount by which it is bent. Specifically, when marking wrench 300 rotates a nut in a clockwise direction, nosepiece body 534 bends and pushes against strain-pin 510 which, in turn, applies a load onto strain-beam 508 causing it to bend. Through calibration, the amount of stress on the strain-beam as a result of being bent is related to torque, enabling torque to be measured.

More particularly, as a result of the bending of strain-beam 508, a voltage sent to the strain-beam changes, due to the strain-beam's change in resistance, then an instrumentation amplifier on main circuit board 502 amplifies this signal. The amplified voltage signal, or analog signal, is sent to a suitable microcontroller, such as a Microchip PIC microcontroller, on the main circuit board 502. The microcontroller has analog-to-digital converter capability so that the analog voltage can be converted to digital format. In digital format, the microcontroller can apply various measured and stored correction factors, such as the calibration factor, to compute torque.

FIG. 5 also illustrates vibrating motor 512 in housing body 312, which may be used for tactile feedback. Vibrating motor 512 may turn on for two seconds after marking wrench 300 has completed rotation of a nut to indicate to a user that the nut is fully tightened so that the user may get ready for the wrench to mark the tightened nut and associated fitting.

Figure 6:
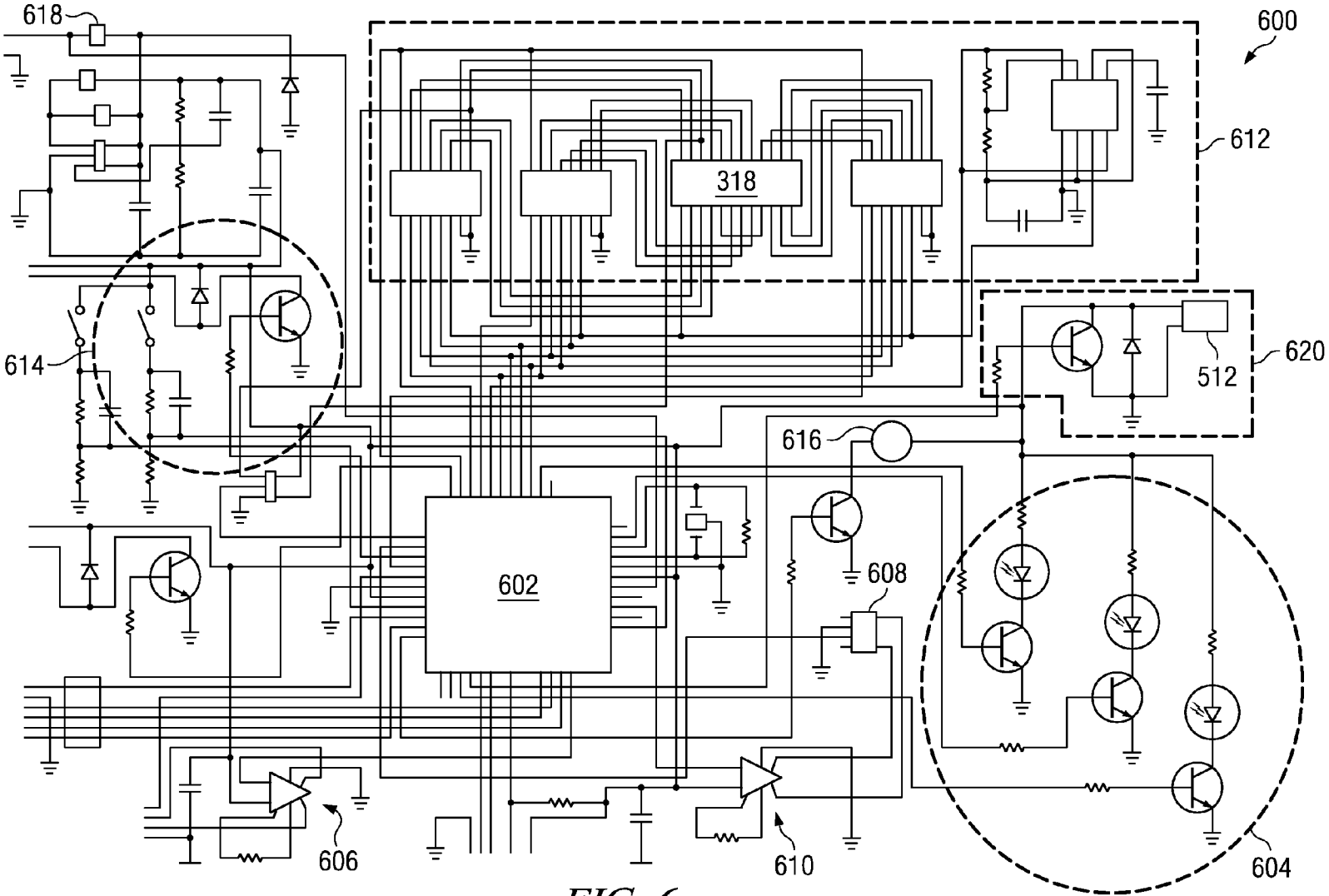
FIG. 6 is an illustration of an electronic circuit diagram of the main circuit board shown in FIG. 5 according to an advantageous embodiment of the disclosure.

FIG. 6 is an illustration of an electronic circuit diagram of the main circuit board illustrated in FIG. 5 according to an advantageous embodiment of the disclosure. The electronic circuit is generally designated by reference number 600 and may include a Microchip microcontroller 602, for example, a PIC16F877A microcontroller operating at 16 MHz, for controlling marking wrench 300. Microcontroller 602 may contain 8K, 14-bit words of programmable flash memory and 256 X 8 bytes of EEPROM data memory, and may include 30 input/output (I/O) ports. As shown in FIG. 6, electronic circuit 600 may also include LED operation components 604 for controlling the operation of status lights 324, 326 and 328, strain-beam amplifier circuit 606 for use in measuring torque, pressure sensor circuit 608 and pressure sensor amplifier circuit 610 for use in the marking system of the marking wrench, LCD integrated circuit 612 for display 318, membrane switch and debounce circuit 614, which is needed to assure that buttons 320 and 322 function properly (otherwise pressing a button might turn on then turn off the wrench), buzzer 616, resettable fuse 618, which is needed in situations when the batteries are inadvertently installed with reverse polarity, and vibrating motor circuit 620 that includes vibrating motor 512.

Figure 7:
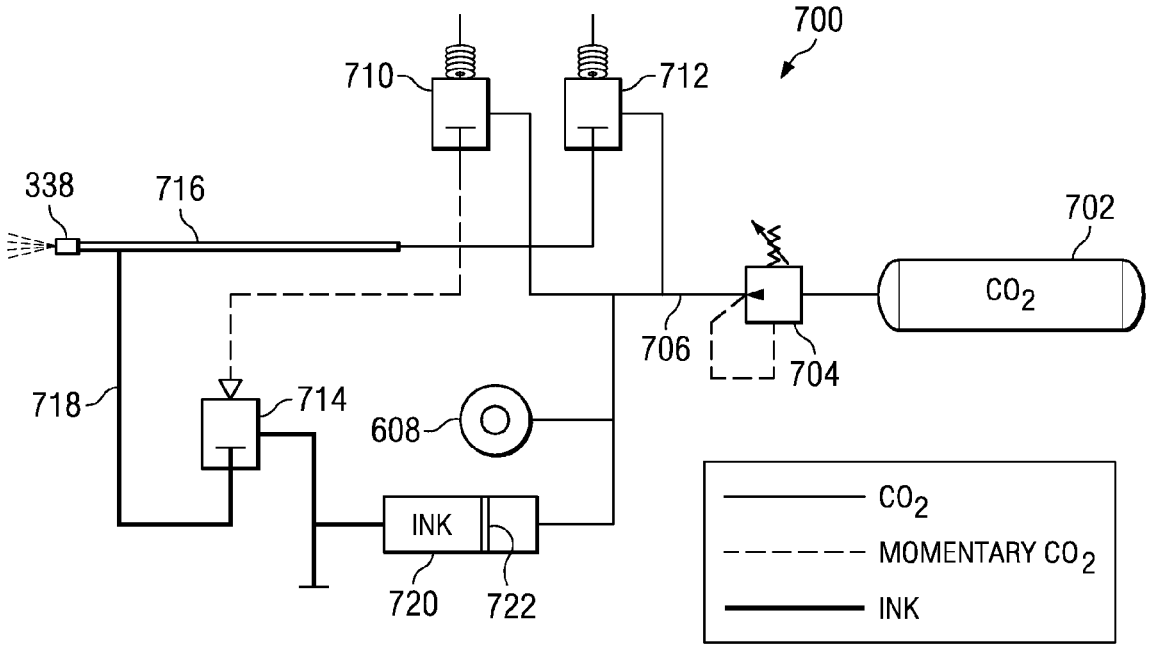
FIG. 7 is an illustration of a fluid circuit diagram representing a fluid system of the marking system of the combined wrench and marking system of FIGS. 3-5 according to an advantageous embodiment of the disclosure.

FIG. 7 is an illustration of a fluid circuit diagram representing a fluid system of the marking system of the combined wrench and marking system of FIGS. 3-5 according to an advantageous embodiment of the disclosure. The marking system includes the fluid system, an ink injection system and parts of the marking wrench control system including the pressure sensor 608 and the pressure sensor amplifier 610 (not shown in FIG. 7).

The fluid system is generally designated by reference number 700. $CO_2$ may be delivered by a disposable 16 gram, or other size, $CO_2$ cylinder 702 which contains $CO_2$ at approximately 900 psig. As shown in FIG. 4, cylinder 702 may be supported in hollow handle cap 310. Adjustable high pressure regulator 704 may be preset, by the wrench manufacturer, to output a pressure of about 25 psig from cylinder 702. Low pressure line 706 from regulator 704 may be split into four lines. One line may be directed to pressure sensor 608. Here, the control program, using pressure sensor 608 and pressure sensor amplifier 610 monitors the $CO_2$ pressure of the lines. When the pressure goes below 22 psig or above 30 psig, the control program may signal the user to change the $CO_2$ cylinder 702.

The control program checks for over pressure as well as for under pressure because when the pressure in $CO_2$ cylinder 702 drops from use, the low pressure left in the cylinder may cause regulator 704 to increase the outlet pressure to considerably above 25 psig.

Two lines of the four lines split from line 706 may supply flow to solenoid-actuated valves 710 and 712. Valve 710 may be used to operate pilot actuated valve 714 which, in turn, may inject ink into nozzle line 716 via ink line 718. Solenoid-actuated valve 712 may be used to flood nozzle line 716 with $CO_2$ so as to propel the ink out spray nozzle 338 during a marking operation.

The fourth line split from line 706 may go directly into ink reservoir 720 which may comprise a low volume pump. A piston, schematically shown at 722, may separate the $CO_2$ from the ink in reservoir 720 which is always pressurized. The ink should be pressurized so that it will function properly in all orientations of the marking wrench, especially when spraying in an overhead direction.

The following sequence of events may occur to actuate an ink spray shot:

1. Solenoid actuated valve 710 directs $CO_2$ to pilot actuated valve 714 for a time duration of approximately 10 milliseconds, which is controlled by the control program, to open valve 714;
2. Solenoid-actuated valve 710 during the time duration controls the amount of ink injected into nozzle line 716;
3. Solenoid-actuated valve 710 is turned off at the end of the time duration;
4. Solenoid-actuated valve 712 directs $CO_2$ into nozzle line 716 to propel ink to spray nozzle 338;
5. Spray nozzle 338 aids in atomizing the ink as the ink is sprayed out of the nozzle and onto a nut and fitting.

Figure 8:
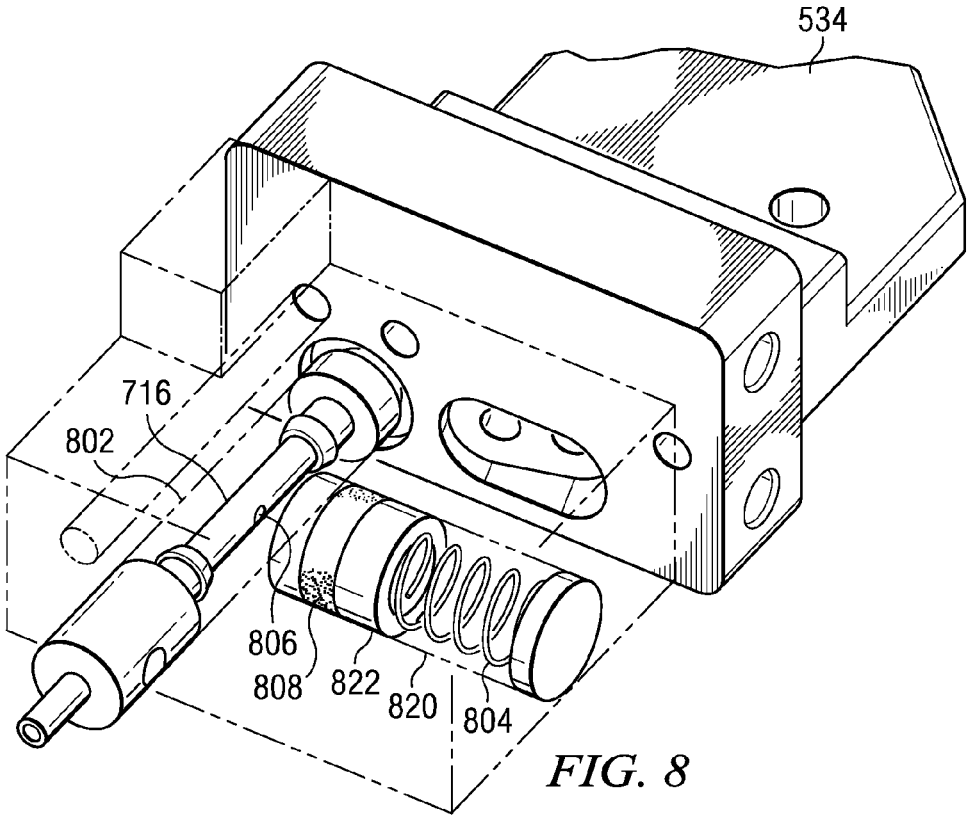
FIG. 8 is an illustration showing an enlarged view of the nosepiece body of the combined wrench and marking system of FIGS. 3-5.

FIG. 8 is an illustration showing an enlarged view of the nosepiece body of the combined wrench and marking system of FIGS. 3-5. At rest, ink resides in between the inside surface of sleeve 802, which is made from a flexible plastic tubing such as polyurethane, and the outside surface of nozzle line 716 (note that other components illustrated in FIG. 8 are shown in phantom lines to better illustrate structural features). Spring 804 maintains positive pressure on the piston 822 which in turn puts pressure on sleeve 802 to maintain a no ink flow condition. When valve 710 (not shown in FIG. 8) is actuated, $CO_2$ is directed into the cylinder 820 containing piston 822, causing the piston to compress spring 804, and to move away from the sleeve 802, uncovering ink inlet 806 (a small hole) in nozzle line 716. O-ring 808 maintains a fluid-tight condition between piston 822 and the cylinder 820 as the piston moves within the cylinder. The valve on-time controls the amount of ink injected into nozzle line 716.

FIG. 9 is an illustration showing an enlarged view of the display and control panel of the combined wrench and marking system of FIGS. 3-5. As indicated with reference to FIG. 3, display and control panel 316 may include display 318, On/Set button 320, Mode button 322, and status lights 324, 326 and 328.

Display 318 may be an LCD (liquid crystal display), and may display three seven-segment digits without decimal points which may be used to represent letters or numbers. For example, FIG. 9 schematically illustrates display 318 displaying the digits "70" which may represent the letters "TO" for "torque".

On/Set button 320 has two functions. The On feature turns marking wrench 300 on and off. The Set feature may be used to set (store) a value into memory. Mode button 322 may be used for selecting a desired function among several available functions as will be described hereinafter.

Status lights 324, 326 and 328 may comprise LEDs (light emitting diodes) of three different colors. For example light 324 may be green, light 326 may be yellow, and light 328 may be red. According to an advantageous embodiment, green LED 324 may be on during torque measurement, yellow LED 326 may be on during angle measurement, and red LED 328 may go on when angle measurement is complete. In addition, red LED 328 may go on in conjunction with messages being displayed on display 318 to indicate a fault, such as that the battery needs changing, the $CO_2$ cylinder needs replacing or that the gyroscope needs replacing.

Figure 10:
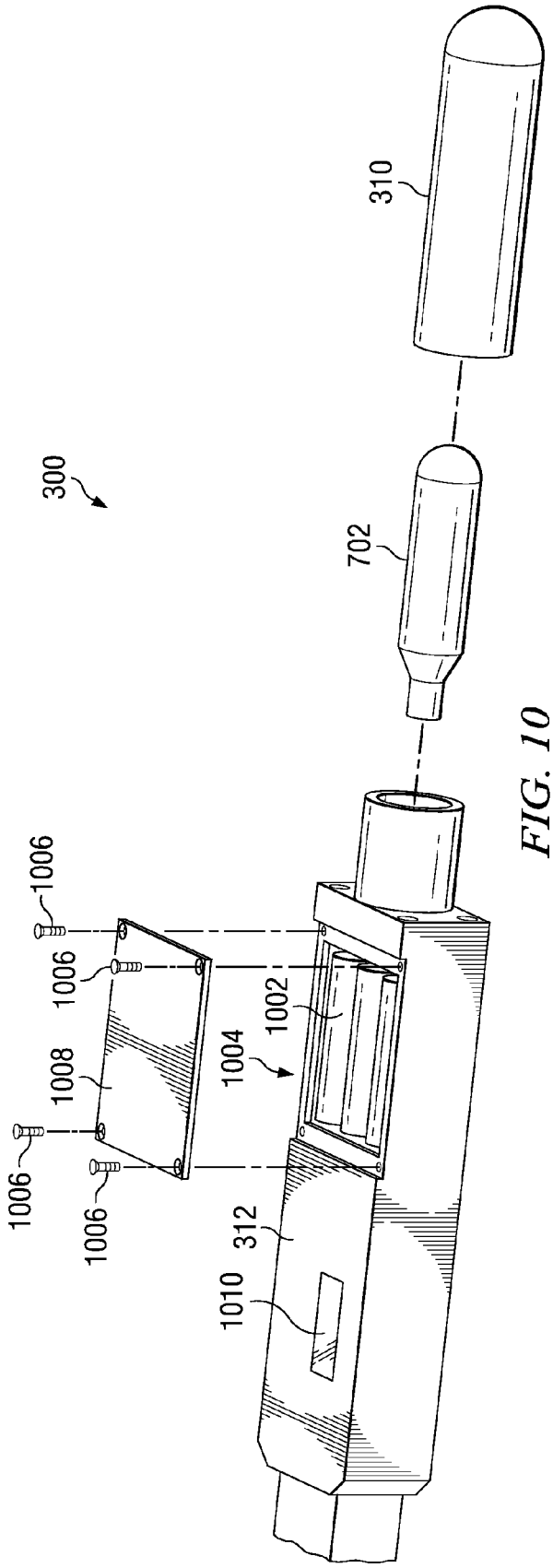
FIG. 10 is an illustration of a portion of the combined wrench and marking system of FIGS. 3-5, looking in the direction of arrow 8 in FIG. 3, to show features of the combined wrench and marking system according to an advantageous embodiment of the disclosure.

FIG. 10 is an illustration of a portion of the combined wrench and marking system of FIGS. 3-5, looking in the direction of arrow 10 in FIG. 3, to show features of the combined wrench and marking system according to an advantageous embodiment of the disclosure. In particular, FIG. 10 shows some features on the underside of marking wrench 300.

As shown in FIG. 10, marking wrench 300 may be provided with electrical power by batteries 1002, for example, three AA batteries carried in battery compartment 1004 in housing body 312. The batteries may be easily replaced when necessary by removing four screws 1006 and removing battery access panel 1008.

FIG. 10 also shows ink supply viewing window 1010. Ink supply viewing window 1010 enables the current level of the ink in ink reservoir 720 to be monitored. When refilling of reservoir 720 is necessary, the refilling may be easily accomplished by injecting ink into the reservoir through ink refill port 332 (see FIG. 3) using a syringe or the like. Ink refill port may be closed by a plug 402 (see FIG. 4) which may be removed during a refilling operation.

FIG. 10 also shows $CO_2$ cylinder 702 which may be easily replaced by fully unscrewing handle cover 310.

Figure 11A:
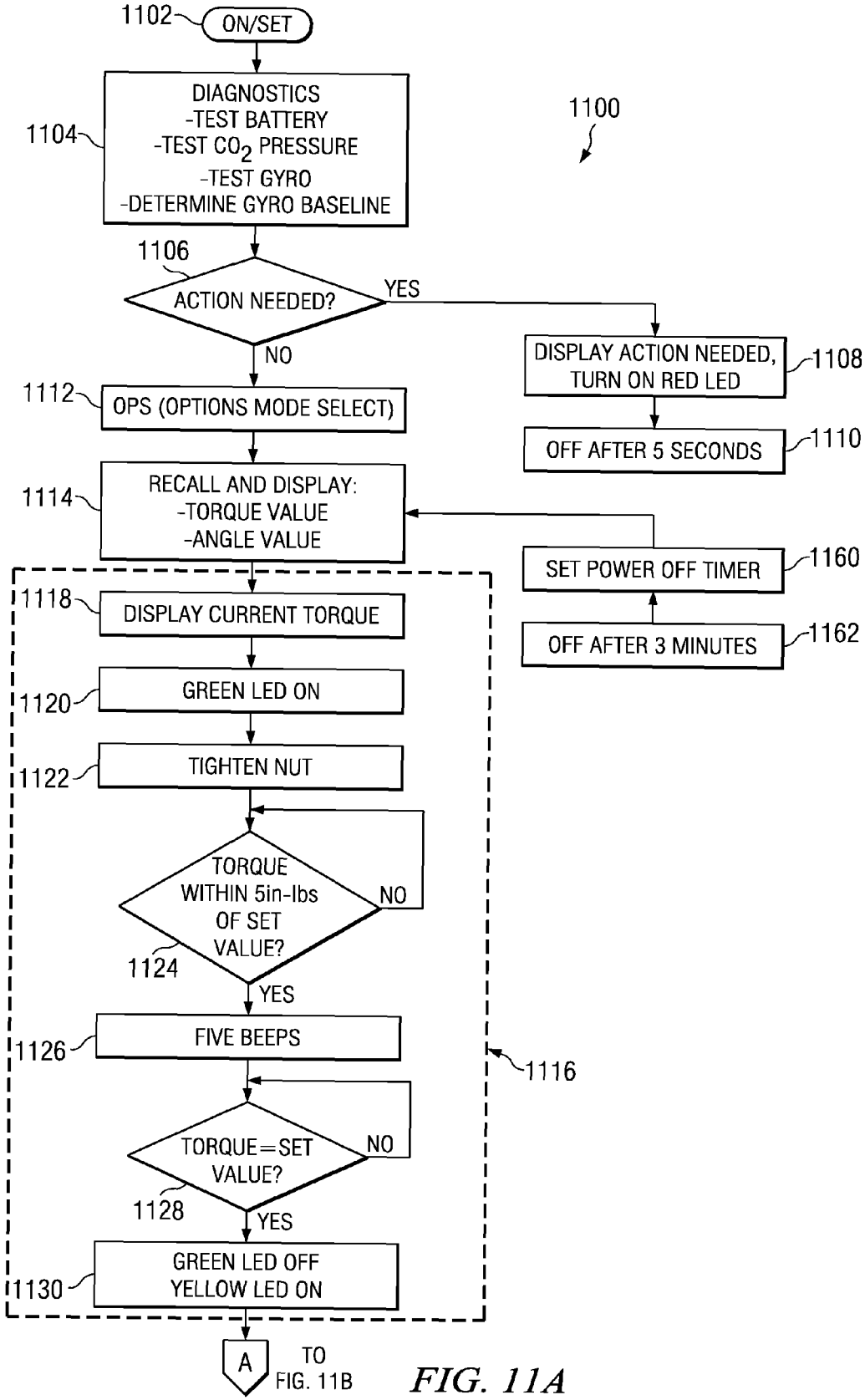
FIGS. 11A and 11B are an illustration of a flowchart that shows program logic for installing fluid fittings and fasteners according to an advantageous embodiment of the disclosure.
Figure 11B:
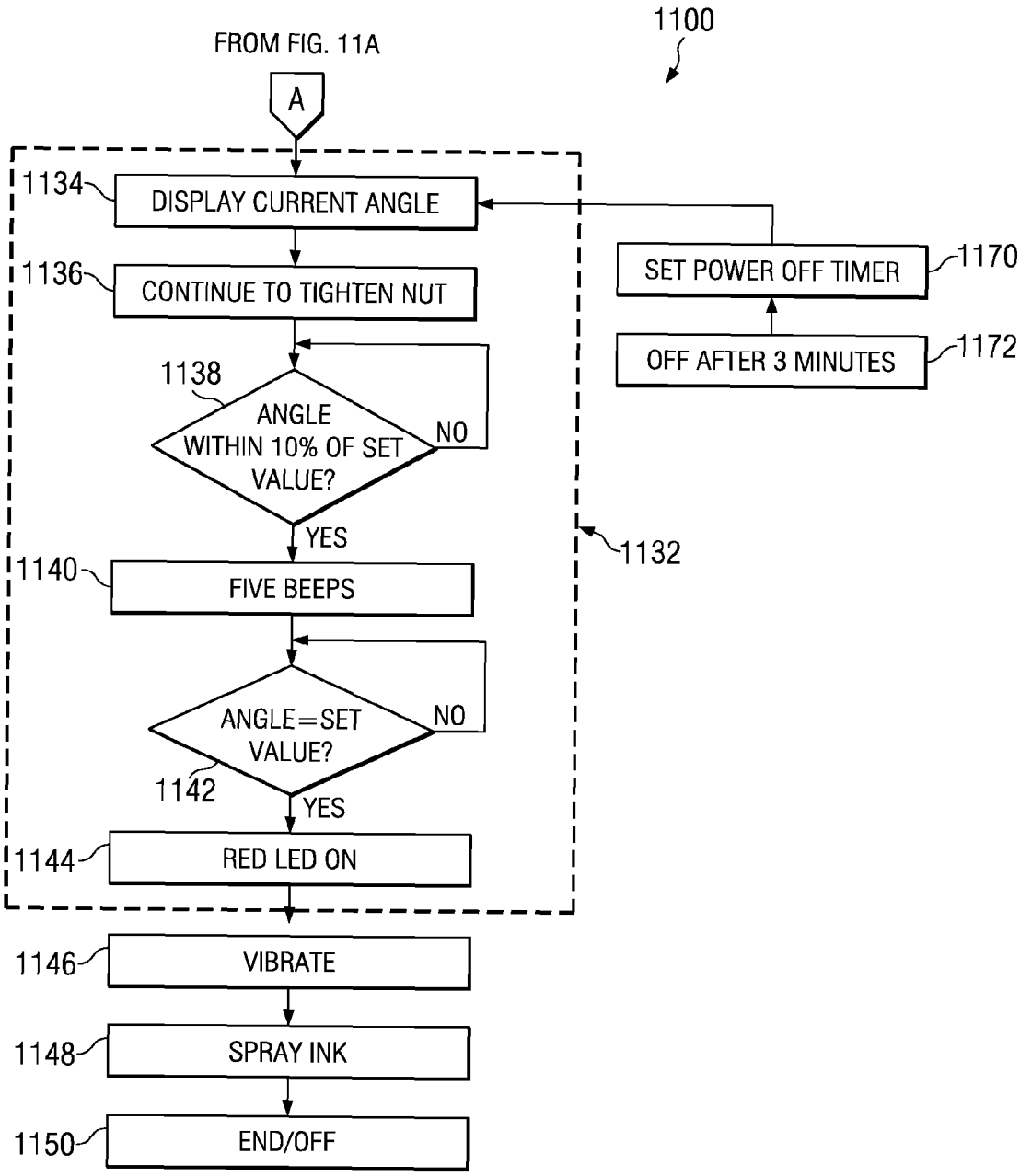

FIGS. 11A and 11B are an illustration of a flowchart that schematically shows program logic for installing fluid fittings and fasteners according to an advantageous embodiment of the disclosure. More particularly, FIGS. 11A and 11B illustrate a method for installing fluid fittings and fasteners using a combined wrench and marking system such as marking wrench 300 in FIGS. 3-5. The method is generally designated by reference number 1100, and begins by turning on the marking wrench (Step 1102) for example, by operating On/Set button 320 on display and control panel 316. The control program then goes through a diagnostic sub-program (Step 1104) during which the program checks battery voltage, $CO_2$ pressure, and gyroscope operation. A determination is made whether any action is needed responsive to the diagnostic tests (Step 1106). If an action is required (Yes output of Step 1106), LCD display 318 displays appropriate symbols indicating the action that is required, and red LED 328 also lights up (Step 1108). After five seconds, the marking wrench will turn off so that the required action(s) may be taken (Step 1110). This will prevent a user from ignoring the display.

During the diagnostic sub-program (Step 1104) the gyroscope baseline may also be determined. The gyroscope baseline may be used to determine the nut angle, and should be determined while the marking wrench is not moving.

Returning to Step 1106, if an action is not required as a result of the diagnostic tests (No output of Step 1106), an options mode may be entered into to select options for operating the marking wrench (Step 1112). Entry into the options mode may be accomplished by pressing mode button 322 on display and control panel 316. FIG. 12 is an illustration of a Table that describes options that may be selected during the options mode in the flowchart of FIGS. 11A and 11B according to an advantageous embodiment of the disclosure.

As shown in FIG. 12, options that may be selected include ink spray adjustment 1202, $CO_2$ spray adjustment 1204, ink amount 1206, change or clear ink 1208, measure angle 1210, and calibrate 1212. FIG. 12 describes each of these options. For example, to change the ink amount (Option 1206), the Mode button 322 is pressed to enter into the options mode, then the Mode button is again pressed when IA- is displayed on display 318 to select the ink amount option 1206. Then the On/Set button 320 is pressed to select and store the amount of ink in each spray. This amount is stored in memory and will not be lost if there is a loss of power to the marking wrench.

A similar procedure is used when the other options shown in FIG. 12 are selected. Certain of the options may require entry of a code to enable the user to make modifications, For example, both the angle measuring option 1210 and the calibrate option 1212 may require the user to enter a code using On/Set button. The calibration option may also be used to store either or both torque and angle preset values.

Returning to FIGS. 11A and 11B, after completion of operations in the options mode (Step 1112), the stored torque and angle values are recalled and displayed (Step 1114). This is so the user may verify that the wrench is set properly. Display 318 may display the torque value followed by the angle value. The marking wrench then starts measuring torque during a nut-tightening operation.

The torque measuring process is generally designated by dashed box 1116, and begins by display 318 displaying current torque (Step 1118). Display 318 may initially display 0 inch-pounds indicating that there is no load on the handle of the marking wrench. Green LED 324 may also turn on indicating that torque is being measured (Step 1120). The user then begins tightening a nut, ratcheting if necessary (Step 1122).

As the nut is tightened, a determination is made whether the measured torque is within a selected percentage of the preset torque value, for example, within 5 inch-pounds of the preset value (Step 1124). If the measured torque is not within 5 inch-pounds of the preset torque value (No output of Step 1124, the method returns to Step 1124 as the nut continues to be tightened. If the torque gets within 5 inch-pounds of the preset torque value (Yes output of Step 1124), buzzer 616 on main printed circuit board 502 may beep five times (Step 1126) as an indicator.

A determination is then made whether the measured torque is equal to the preset torque value (Step 1128). If the measured torque does not equal the preset torque value (No output of Step 1128), the method returns to Step 1128 as the nut continues to be tightened. If the measured torque equals the preset torque value (Yes output of Step 1128), the green LED may turn off and the yellow LED 326 may turn on ending the torque measuring process (Step 1130). The method then switches to an angle measuring mode.

The angle measuring process is generally designated by dashed box 1132, see FIG. 11B. Display 318 may display current angle (Step 1134). Initially, display 318 will show 0 degrees. The user continues to tighten the nut, ratcheting if necessary (Step 1136). A determination is made whether the measured angle is within 10 percent of the preset angle value (Step 1138) If it is determined that the measured angle is not within 10 percent of the preset angle (No output of Step 1138), the method returns to Step 1138 and the user continues to tighten the nut. If the measured angle is within 10 percent of the preset angle (Yes output of Step 1138) buzzer 616 may beep five times as an indicator (Step 1140).

A determination is then made whether the measured angle is equal to the preset angle (Step 1142). If it is determined that the measured angle is not equal to the measured angle (No output of Step 1142), the method returns to Step 1142 and the user continues to tighten the nut. If it is determined that the measured angle is equal to the preset angle (Yes output of Step 1142), the red LED may go on to indicate that angle measurement is complete (Step 1144).

When the preset angle is reached, the wrench may also begin to vibrate (Step 1146). This indicates to the user that the wrench is ready to spray. After a time delay of one second, the marking wrench then sprays both the nut and the fitting (Step 1148). After the spraying, the marking wrench may automatically turn off (Step 1150).

FIG. 13 is an illustration that shows an ink mark sprayed on both a nut and a fitting that has been assembled to a hydraulic line section according to an advantageous embodiment of the disclosure. In particular, FIG. 13 shows an ink mark 1302 sprayed on both nut 1304 and fitting 1306 that have been attached to hydraulic line section 1308 to indicate that the nut and fitting have been properly attached to the line section.

Returning to FIGS. 11A and 11B, marking wrench 300 may include a power off timer that will automatically turn off the wrench after a set time is reached. This timer may be set during torque measuring (Step 1160), and may be reset during angle measuring (Step 1170). The timer may be set for three minutes although other time periods can also be set if desired. If measured torque or measured angle does not change within the set period of time, the marking wrench automatically turns off (Steps 1162 and 1172, respectively).

Figure 14:
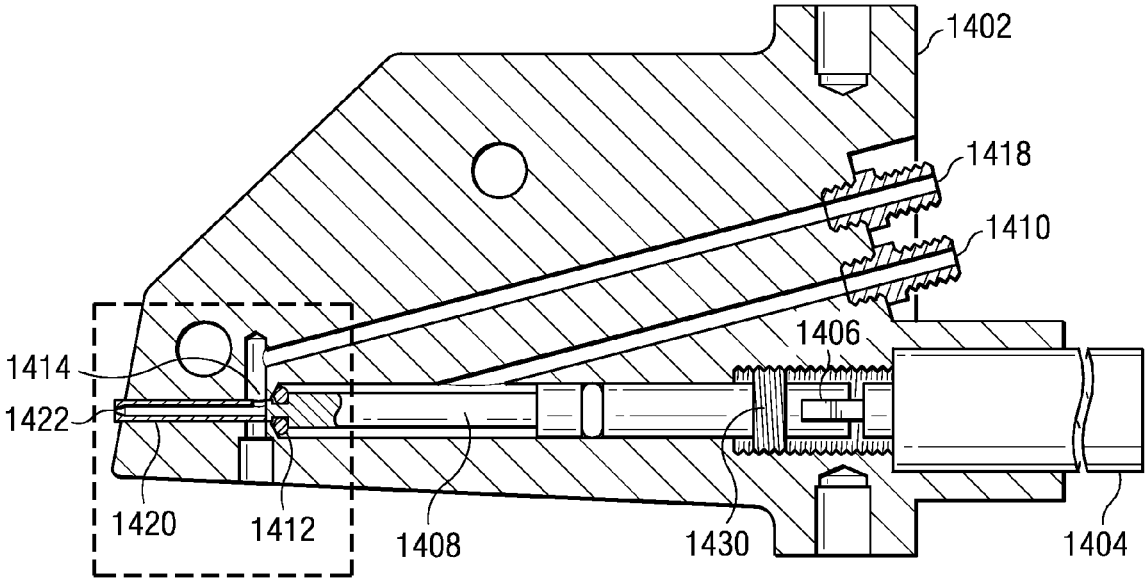
FIG. 14 is an illustration of a cross-section of a nosepiece body of a combined wrench and marking system according to a further advantageous embodiment of the disclosure.

FIG. 14 is an illustration showing a cross-sectional view of a nosepiece body of a combined wrench and marking system according to a further advantageous embodiment of the disclosure. More particularly, FIG. 14 illustrates a marking system in which ink is electronically injected into the ink reservoir rather than by $CO_2$ deployed ink injection as in the advantageous embodiment described with reference to FIGS. 3-10.

Nosepiece body 1402 of the combined wrench and marking system may include a stepper motor 1404 with gearbox which is controlled by the microcontroller 602 on the main circuit board of the combined wrench and marking system. The output shaft on the gearbox may be attached to blade coupling 1406 (shaped similar to a blade screwdriver) which is inserted into a blade receptacle (shaped similar to a slotted screw head) on valve stem 1408. Valve stem 1408 has exterior threads 1430 which mate with interior threads on nosepiece body 1402. Since connected together, by blade coupling 1406 and blade receptacle, rotation of the output shaft causes the valve stem 1408 to rotate in nosepiece body 1402. As this rotation occurs, the valve stem 1408 will either extend or retract into the nosepiece body 1402, depending on the rotation direction of the output shaft. This will cause the blade coupling 1406 to be withdrawn or be further inserted into the blade receptacle. The advantage of this coupling arrangement, is that the thrust force is applied on the threads 1430 and not onto the shaft of the stepper motor 1404.

In operation, ink pressurized to about 5 psig is directed into ink port 1410. No ink flows, however, until valve stem 1408 is retracted. When the stepper motor 1404 is signaled by the control program to rotate a certain number of steps, valve stem 1408 will rotate in nosepiece body 1402 causing the valve to retract from the front ink seal 1412. Retraction is dependent on the valve stem screw threads 1430.

At this point, ink is injected into mixing chamber 1414. The valve stem is then extended forward to seal front ink seal 1412. Then an electronic valve (not shown in FIG. 14, but which functions similarly to valve 712) is signaled to inject $CO_2$ via $CO_2$ flow line 1418 at about 25 psig into mixing chamber 1414. The mixing chamber 1414, is contained within nozzle sleeve 1420. Ink and $CO_2$ mix together in chamber 1414, and the atomized ink is propelled down nozzle sleeve 1420 and out nozzle hole 1422.

Figure 15:
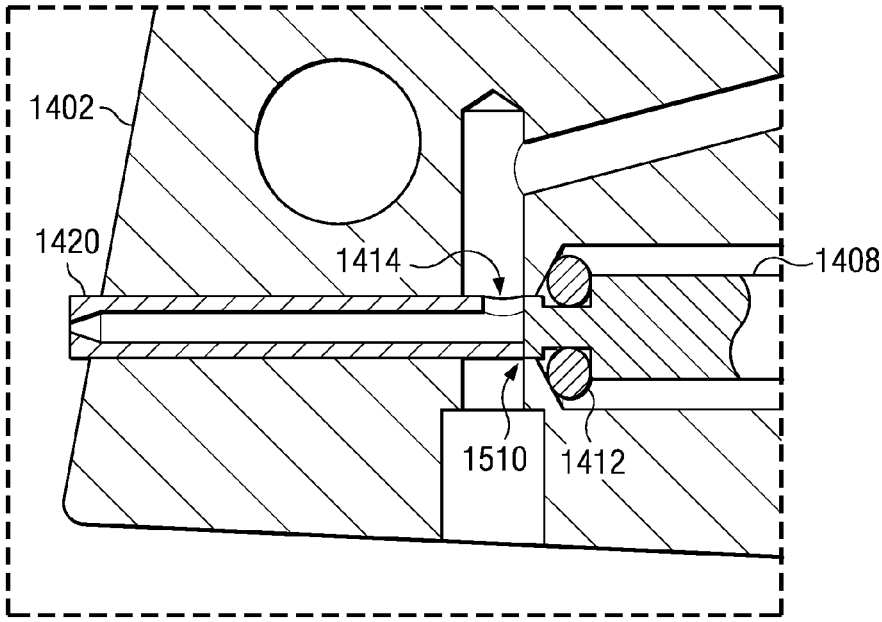
FIG. 15 is an illustration of an enlarged view of the mixing area shown in FIG. 14.

FIG. 15 is an illustration of an enlarged view of the mixing area shown in FIG. 14. FIG. 15 illustrates features to eliminate ink clogging. Specifically, the front portion of valve stem 1408 is designed to retain O-ring 1412 and break up any dried ink when the valve stem 1408 is retracted. This is facilitated through the close tolerance hole in the nosepiece and the O-ring retainer design, generally shown at 1510.

A combined wrench and marking system according to advantageous embodiments is completely self-contained and does not require connection to an external air line or to any other external source. As a result it is easy to handle and manipulate. Use of a combined wrench and marking system according to advantageous embodiments may reduce the number of hydraulic leaks that occur during leak-testing of a fitting that has been attached to a hydraulic line section because both the nut and the fitting are automatically marked only after the nut has been properly tightened. This will help ensure that joints that have not been properly assembled will not be inadvertently marked.

The combined wrench and marking systems according to advantageous embodiments is light in weight and compact in size. In addition, the combined wrench and marking systems according to advantageous embodiments is less than one inch thick and has no protruding components, and thus provides a narrow profile in the plane of rotation of the marking wrench such that the marking wrench may be used in confined areas.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A self-contained combined wrench and marking system, comprising:

a wrench head for rotating a fastener during a fastener tightening operation;

a torque measuring mechanism configured to measure a current torque applied to the fastener during the fastener tightening operation to form a measured torque value;

an angle measuring mechanism, responsive to determining that the measured torque value is equal to a preset torque value, configured to measure a current angle of the fastener during the fastener tightening operation to form a measured angle; and a marking system, responsive to determining that the measured torque value is equal to the preset torque value and responsive to determining that the measured angle is equal to a preset angle, configured to automatically mark both the fastener and a structure assembled by the fastener.

2. The self-contained combined wrench and marking system of claim 1, wherein the wrench head comprises a ratcheting wrench head.

3. The self-contained combined wrench and marking system of claim 1, wherein the torque measuring mechanism comprises:

a strain-beam in a body of the combined wrench and marking system, the strain-beam having a first end attached to the body and a free second end to form a cantilever configuration, a bending of the body during the fastener tightening operation causing a bending of the strain-beam; and a stress measuring mechanism for measuring an amount of stress on the strain-beam, the amount of stress being related to the torque.

4. The self-contained combined wrench and marking system of claim 1, wherein the angle measuring mechanism comprises a gyroscope, the gyroscope comprising a gyroscope circuit board separate from a main circuit board of the self-contained combined wrench and marking system.

5. The self-contained combined wrench and marking system of claim 1, wherein the marking system comprises:

a marking fluid reservoir containing a marking fluid;

a spray nozzle line connected to the marking fluid reservoir for receiving the marking fluid from the marking fluid reservoir;

a replaceable gas cartridge containing a gas propellant; and a control valve for delivering the gas propellant from the replaceable gas cartridge to the spray nozzle line for spraying the marking fluid for marking both the fastener and the structure assembled by the fastener.

6. The self-contained combined wrench and marking system of claim 5, wherein the structure assembled by the fastener comprises a fluid fitting for a hydraulic line of an aircraft.

7. The self-contained combined wrench and marking system of claim 5, wherein the replaceable gas cartridge is in a handle of the self-contained combined wrench and marking system.

8. The self-contained combined wrench and marking system of claim 3, wherein the stress measuring mechanism is configured to measure a change in a voltage signal sent to the strain-beam due to a change in resistance in the strain-beam.

9. The self-contained combined wrench and marking system of claim 1, and further comprising a vibrating mechanism, responsive to the measured angle being equal to a preset angle, for vibrating to indicate to a user that the fastener and the structure assembled by the fastener is ready to be marked.

10. A self-contained combined wrench and marking system, comprising:

a wrench, the wrench comprising:

a wrench head for rotating a fastener during a fastener tightening operation;

a torque measuring mechanism for measuring a torque applied to the fastener during the fastener tightening operation; and an angle measuring mechanism for rotating the fastener to a preset angle during the fastener tightening operation; and a marking system for automatically marking the fastener after the torque is applied to the fastener and after rotating the fastener to the preset angle, wherein the marking system comprises:

a marking fluid reservoir containing a marking fluid;

a spray nozzle line connected to the marking fluid reservoir for receiving the marking fluid from the marking fluid reservoir;

a replaceable gas cartridge containing a gas propellant;

a first control valve for delivering the gas propellant from the replaceable gas cartridge to the spray nozzle line for spraying the marking fluid for marking the fastener; and a second control valve for delivering the gas propellant from the replaceable gas cartridge to the marking fluid reservoir for delivering the marking fluid from the marking fluid reservoir to the spray nozzle line.

11. A method for installing a fitting and for marking automatically an installed fitting, the method comprising:

rotating a fastener to attach the fitting during a fastener tightening operation;

measuring a current torque value applied to the fastener during the fastener tightening operation to provide a measured torque value;

responsive to determining that the measured torque value is equal to a preset torque value, measuring a current angle of the fastener during the fastener tightening operation to form a measured angle; and responsive to determining that the measured torque value is equal to the preset torque value and responsive to determining that the measured angle is equal to a preset angle, marking automatically both the installed fitting and the fastener.

12. The method of claim 11, wherein marking automatically both the installed fitting and the fastener, comprises:

delivering a gas propellant from a replaceable gas cartridge to a spray nozzle line for spraying marking fluid from the spray nozzle line.

13. The method of claim 11, wherein the fitting comprises a fluid fitting for a hydraulic line of an aircraft.

14. A method for installing a fitting and for marking automatically an installed fitting, the method comprising:

rotating a fastener to attach the fitting during a fastener tightening operation;

measuring a torque applied to the fastener during the fastener tightening operation;

rotating the fastener to a preset angle during the fastener tightening operation to install the fitting; and marking automatically the installed fitting and the fastener after applying the torque to the fastener and after rotating the fastener to the preset angle, wherein marking automatically the installed fitting and the fastener comprises:

delivering a gas propellant from a replaceable gas cartridge to a spray nozzle line for spraying marking fluid from the spray nozzle line; and delivering the gas propellant from the replaceable gas cartridge to a marking fluid reservoir for delivering the marking fluid from the marking fluid reservoir to the spray nozzle line.

15. A self-contained combined wrench and marking system, comprising:

a wrench, the wrench comprising:

a ratcheting wrench head for rotating a fastener during a fastener tightening operation;

a torque measuring mechanism for measuring a torque applied to the fastener during the fastener tightening operation, the torque measuring mechanism including:

a strain-beam that is stressed during the fastener tightening operation; and a stress measuring mechanism for measuring an amount of stress on the strain-beam, wherein the amount of stress is related to torque; and an angle measuring mechanism for rotating the fastener to a preset angle during the fastener tightening operation, the angle measuring mechanism including a gyroscope; and a marking system for automatically marking the fastener after the torque measuring mechanism determines that the torque applied to the fastener is equal to a preset torque value and after the angle measuring mechanism determines that the fastener is rotated to the preset angle, the marking system comprising:

a marking fluid reservoir containing a marking fluid;

a spray nozzle line connected to the marking fluid reservoir for receiving the marking fluid from the marking fluid reservoir;

a replaceable gas cartridge containing a gas propellant;

a first control valve for delivering the gas propellant from the replaceable gas cartridge to the marking fluid reservoir for delivering the marking fluid from the marking fluid reservoir to the spray nozzle line; and a second control valve for delivering the gas propellant from the replaceable gas cartridge to the spray nozzle line for spraying the marking fluid for marking the fastener.

16. A method for installing a fitting and for marking automatically an installed fitting, the method comprising:

a fastener tightening operation, the fastener tightening operation comprising:

rotating a fastener to attach the fitting;

measuring a torque applied to the fastener while rotating the fastener to apply a preset torque to the fastener; and measuring a rotation angle of the fastener while rotating the fastener for rotating the fastener to a preset angle to install the fitting; and a marking operation for marking automatically the installed fitting and the fastener, the marking operation comprising:

delivering a gas propellant from a replaceable gas cartridge to a marking fluid reservoir for delivering a marking fluid from the marking fluid reservoir to a spray nozzle line; and delivering the gas propellant from the replaceable gas cartridge to the spray nozzle line for spraying the marking fluid from the spray nozzle line.

* * * * *